US007849606B2

(12) United States Patent
Laitta et al.

(10) Patent No.: US 7,849,606 B2
(45) Date of Patent: Dec. 14, 2010

(54) POOL MEASUREMENT TOOL, SYSTEM AND METHOD

(76) Inventors: Rich Laitta, c/o S.R. Smith, LLC, 1017 SW. Berg Pkwy., Canby, OR (US) 97013; Jason Weisenfluh, c/o S.R. Smith, LLC, 1017 SW. Berg Pkwy., Canby, OR (US) 97013; James Bonander, c/o S.R. Smith, LLC, 1017 SW. Berg Pkwy., Canby, OR (US) 97013

( * ) Notice: Subject to any disclaimer, the term of this patent is extended or adjusted under 35 U.S.C. 154(b) by 0 days.

(21) Appl. No.: 12/016,036

(22) Filed: Jan. 17, 2008

(65) Prior Publication Data

US 2008/0229600 A1 Sep. 25, 2008

Related U.S. Application Data

(60) Provisional application No. 60/885,392, filed on Jan. 17, 2007.

(51) Int. Cl.
*G01B 3/04* (2006.01)
*A63C 19/06* (2006.01)

(52) U.S. Cl. ..... 33/562; 33/1 G

(58) Field of Classification Search ..... 33/1 G, 33/1 AA, 1 CC, 759, 755
See application file for complete search history.

(56) References Cited

U.S. PATENT DOCUMENTS 165,383 A * 7/1875 Tilney ..... 33/16
1,241,498 A * 10/1917 Sherwood ..... 105/49
3,039,197 A * 6/1962 Abbott ..... 33/456
3,668,781 A * 6/1972 Teter ..... 33/1 H
4,160,324 A * 7/1979 Dunn ..... 33/759
5,012,590 A * 5/1991 Wagner et al. ..... 33/759
5,371,949 A * 12/1994 Delaurier ..... 33/1 G
6,216,629 B1 * 4/2001 Straub ..... 116/209
RE37,212 E * 6/2001 Marshall ..... 33/759
6,253,456 B1 * 7/2001 Cooksey ..... 33/1 G
6,430,819 B1 * 8/2002 Aldstadt et al. ..... 33/1 G
2002/0095274 A1 * 7/2002 Richards et al. ..... 703/1
2003/0061722 A1 * 4/2003 Bradley ..... 33/563

* cited by examiner

*Primary Examiner*—Christopher W Fulton
(74) *Attorney, Agent, or Firm*—patenttm.us

(57) ABSTRACT

A pool measuring tool comprises a template tool and instructions for use for ensuring compliance with depth and position standards for diving board safety in placement of pool diving boards. The template comprises web members to extend across the pool along the centerline of the diving board placement and across the pool perpendicular to the centerline. Markers are provided to indicate positions where measurements are to be taken of the pool parameters, including pool depth and noting existence of obstructions in the pool. Measurements at the maker locations can be recorded on a worksheet for record keeping and to confirm and document compliance with various standards for diving board/pool diving safety can thereby be accomplished.

11 Claims, 4 Drawing Sheets

| MINIMUM DEPTHS | | | | | | | | | | | | |
|---|---|---|---|---|---|---|---|---|---|---|---|---|
| POINTS | A | B | C | D | F1 | F2 | H1 | J1 | K1 | H2 | J2 | K2 |
| MINIUMUM | 6'0" | 7'6" | 5'0" | 2'9" | 2'9" | 2'9" | 4'0" | 7'2 1/2" | 7'6" | 4'0" | 7'2 1/2" | 7'6" |
| ACTUAL | | | | | | | | | | | | |

| LENGTHS | |
|---|---|
| POINTS | WA |
| MINIMUM | 1'6" |
| ACTUAL | |

| SLOPE | | | | | | | | | | | |
|---|---|---|---|---|---|---|---|---|---|---|---|
| POINTS* | B | S1 | S2 | S3 | S4 | S5 | S6 | S7 | S8 | S9 | S10 |
| ACTUAL DEPTH | | | | | | | | | | | |

* Measure every 2' between points B & E. (8" maximum difference between each pair of points)

| MINIMUM DEPTHS | | | | | | | | | | | | |
|---|---|---|---|---|---|---|---|---|---|---|---|---|
| POINTS | A | B | C | D | F1 | F2 | H1 | J1 | K1 | H2 | J2 | K2 |
| MINIUMUM | 6'0" | 7'6" | 5'0" | 2'9" | 2'9" | 2'9" | 4'0" | 7'2 1/2" | 7'6" | 4'0" | 7'2 1/2" | 7'6" |
| ACTUAL | | | | | | | | | | | | |

| LENGTHS | |
|---|---|
| POINTS | WA |
| MINIMUM | 1'6" |
| ACTUAL | |

| SLOPE | | | | | | | | | | | |
|---|---|---|---|---|---|---|---|---|---|---|---|
| POINTS* | B | S1 | S2 | S3 | S4 | S5 | S6 | S7 | S8 | S9 | S10 |
| ACTUAL DEPTH | | | | | | | | | | | |
| * Measure every 2' between points B & E. (8" maximum difference between each pair of points) | | | | | | | | | | | |

| MINIMUM DEPTHS | | | | | | | | | | | | |
|---|---|---|---|---|---|---|---|---|---|---|---|---|
| POINTS | A | B | C | D | F1 | F2 | H1 | J1 | K1 | H2 | J2 | K2 |
| MINIMUM | 6'0" | 7'6" | 5'0" | 2'9" | 2'9" | 2'9" | 4'2" | 7'2 1/2" | 7'6" | 4'2" | 7'2 1/2" | 7'6" |
| ACTUAL | | | | | | | | | | | | |

| LENGTHS | |
|---|---|
| POINTS | WA |
| MINIMUM | 1'6" |
| ACTUAL | |

| SLOPE | | | | | | | | | | | |
|---|---|---|---|---|---|---|---|---|---|---|---|
| POINTS* | B | S1 | S2 | S3 | S4 | S5 | S6 | S7 | S8 | S9 | S10 |
| ACTUAL DEPTH | | | | | | | | | | | |

* Measure every 2' between points B & E. (8" maximum difference between each pair of points)

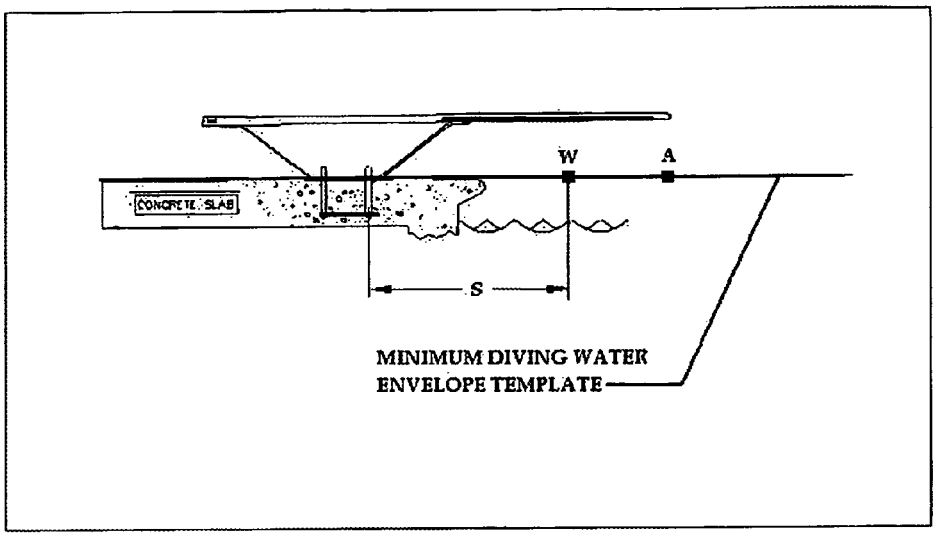

| POOL TYPE II | | | | |
|---|---|---|---|---|
| Stand Model | Board Length (feet) | Standard Distance for Setting Jig from Water's Edge (inches) (S) | Minimum Overhang (Inches) (WA) | Maximum Height Over Water (inches) |
| Model 1 | length value | length value | length value | length value |
| Model 2 | length value | length value | length value | length value |
| Model 3 | length value | length value | length value | length value |
| Model 4 | length value | length value | length value | length value |
| . | . | . | . | . |
| . | . | . | . | . |
| . | . | . | . | . |
| . | . | . | . | . |

FIG. 4

POOL MEASUREMENT TOOL, SYSTEM AND METHOD

BACKGROUND OF THE INVENTION

This invention relates to swimming pools and more particularly to a tool, system and method for measuring swimming pools for compliance with diving board installation requirements.

Swimming pool owners often wish to have diving boards installed for use with the pool. For safe use, the swimming pool should have certain dimensions in order to enable use of the diving board. The American National Standards Institute has published standards (ANSI-NSPI-5 (2003)) that provides recommended minimum guidelines for residential inground swimming pool design, equipment, installation, and use. The standards are also used by local governments and regulatory bodies in preparing inground swimming pool guidelines and requirements.

These standards include depth profiles that a pool should conform to in order to comply with the standards.

For installers of diving boards, it is important to ensure that a pool complies with the standards, but it can be difficult to make the required measurements.

SUMMARY OF THE INVENTION

In accordance with the invention, a tool is provided that enables measurement of the required depth profiles to ensure conformance with standards for pool depth profiles for diving board use.

Accordingly, it is an object of the present invention to provide an improved tool for assisting in measuring pool profiles.

It is a further object of the present invention to provide an improved system and method for measuring swimming pool depth profiles.

It is yet another object of the present invention to provide an improved pool measuring tool.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE DRAWINGS

FIG. 4 is an exemplary chart and placement diagram illustrating the dimensions of exemplary diving boards that would be acceptable under the standards, and positioning directions for placement of a board mounting jig for marking location of installation of the board support for a particular configuration of diving board.

DETAILED DESCRIPTION

The system according to a preferred embodiment of the present invention comprises a tool and method of use of the tool and system for measuring pool profiles.

Figure 1:
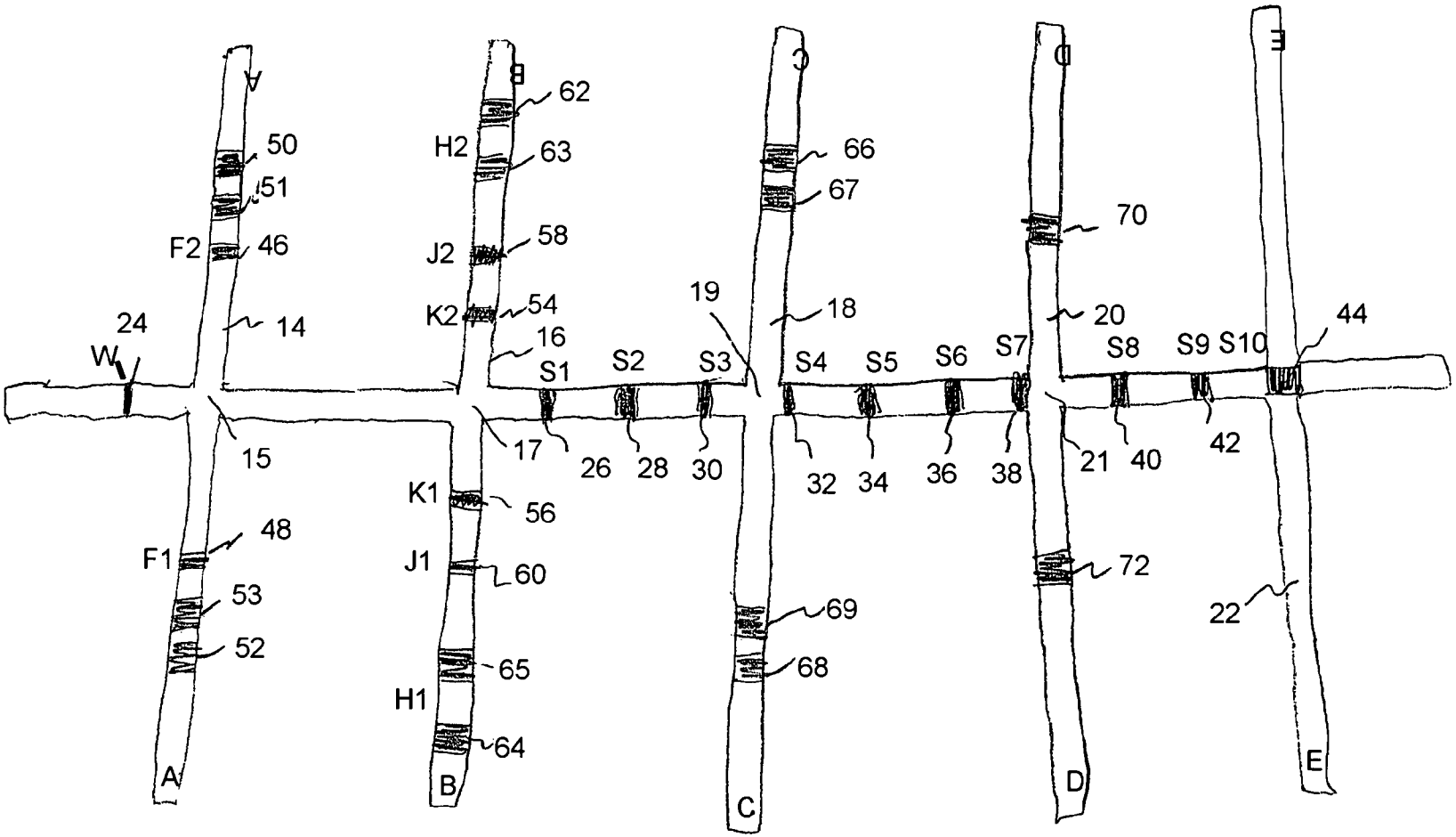
FIG. 1 is an illustration of a particular embodiment of a measuring tool in accordance with the invention.

Referring to FIG. 1, a view of an exemplary pool measurement tool 10, the tool suitably comprises a centerline web portion 12 with plural cross section web portions 14, 16, 18, 20 and 22 at spaced positions along the length of the portion 12, preferably at right angles to the centerline portion. Portions 14-22 are labeled A, B, C, D and E, respectively. Portion 12 carries a marker line 24 with the letter "W" thereon at one end thereof, the end adjacent which cross section web portion 14 ("A") is positioned.

Centerline portion 12 is suitably 60 feet long while each of the cross section web portions are suitably 30 feet long, in the preferred embodiment.

Positioned along the length of centerline portion are pool slope measurement marker lines 26, 28, 30, 32, 34, 36, 38, 40, 42 and 44, which are represented as points S1 through S10.

The various cross section web members have marker lines thereon, cross section member 14 having lines and 48 spaced equidistant from the centerline, and markers 50, 52 further out on the lengths of the cross section member, again spaced equidistant from the centerline. Markers 51, 53 are positioned inwardly toward the centerline somewhat from markers 51, 52. Member 16 has 3 such markers on each side of the centerline, markers 56, 60 and 64 on the lower side as viewed in FIG. 1, representing measurement label items K1, J1 and H1, and markers 54, 58 and 62 on the upper side as viewed in FIG. 1, representing measurement label items K2, J2 and H2. Markers 63, 65 are positioned inwardly toward the centerline somewhat from markers 62, 64. Cross section member 18 has markers 66 and 68 spaced equidistant from the centerline, with markers 67, 69 spaced inwardly closer to the centerline from markers 66, 68. Member 20 has markers 70 and 72 spaced equidistant from the centerline, while member 22 carries only the centerline marker 44 thereon. Markers 50, 52, 62, 64, 66, 68 may suitably be provided in different texture or color than markers 51, 53, 63, 65, 67 and 69.

In use, the various markers provide measurement points for taking measurements to record the measurement profile of a pool, as measured from the waterline. To use the tool, the pool length width and depth at deepest point are measured, and the type and length of diving board desired may also be determined at this point. Next the position of cross section A (member 14) is determined at a 6 foot water depth a minimum of 1 foot 6 inches from the pool wall. This position may be marked on the pool deck for proper positioning of the tool. The pool centerline is then determined by stretching the tool across the pool and lining up the centerline and cross section A line 14 with the marks on the pool deck. Both ends of the centerline member are then secured. The cross section member positions are measured and secured along the pool deck, with the distance between cross section member A 14 and B 16 being 7 feet, between B 16 and C 18 being 7 feet 6 inches, between C 18 and D 20 being 6 feet 9 inches, between D 20 and E 22 being 6 feet. Next it is determined whether an obstruction exists inside the envelope 74 (defined by position markers 51, 53, 63, 65, 67, 69, 70, 72 and 44 for a type I pool or between position markers 50, 52, 62, 64, 66, 68, 70, 72 and 44 for a type II pool). If an obstruction exists, adjustment of the centerline position may be made (if possible) to provide an obstruction free area inside the envelope. The centerline member 12 is then pulled taut from the opposite end, and each of the cross section members 14, 16, 18, 20 and 22 are also suitably pulled taut with respect to the pool sides.

Figure 2:
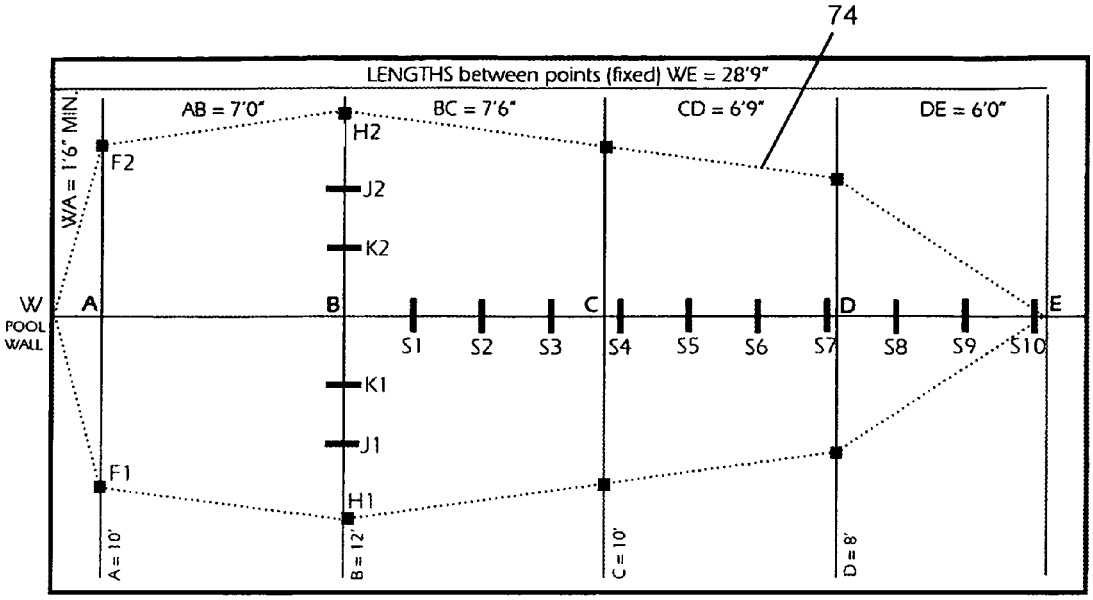
FIG. 2 is a view of a first type pool envelope measurement profile.
Figure 3:
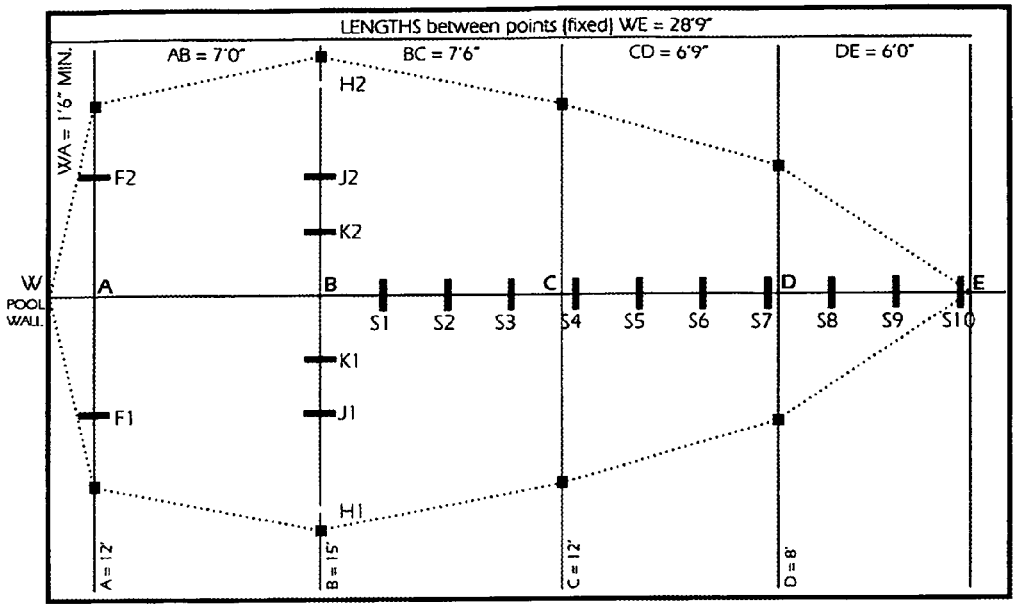
FIG. 3 is a view of a second type pool envelope measurement profile.

Measurements of pool depth relative to the waterline are then taken at the various marker points, and may suitably be recorded on a form as shown in FIG. 2 or FIG. 3, which represent exemplary forms for recording the measurements and comparing to the required minimums for meeting pool type I and pool type II standards under the ANSI-NSPI-5 (2003) pool standards.

Under the pool type I standards, minimum depths are:

At the position where centerline 12 and the following cross section members cross:

| | |
|---|---|
| member 14, position 15 | 6 feet |
| member 16, position 17 | 7 feet 6 inch |
| member 18, position 19 | 5 feet |
| member 20, position 21 | 2 feet 9 inch |

At positions on the various cross section members:

| | |
|---|---|
| Positions 46, 48 | 2 feet 9 inch |
| Positions 62, 64 | 4 feet |
| Positions 58, 60 | 7 feet, 2.5 inch |
| Positions 54, 56 | 7 feet, 6 inch |

The distance from the centerline member to positions 46, 48 is suitably 5 feet, to positions 62, 64 is suitably 6 feet, to positions 66, 68 is suitably 6 feet, and to positions 70, 72 is suitably 4 feet.

Measurements are further taken to determine whether the pool slope meets the standards, beginning where member 16 crosses centerline member (at position 17), a pool depth measurement is made, and subsequent measurements are made at each of positions 26, 28, 30, 32, 34, 36, 38, 40, 42 and 44. Each of these positions is suitably 2 feet from the adjacent position, and, to conform to the standard, there can be no more than maximum difference between each pair of adjacent points of 8 inches.

The distance to the pool wall and position 15, where cross member 14 crosses the centerline member, is suitably at least 1 foot 6 inches minimum under the standard, cross member 14 being positioned under the furthest tip of the diving board, so line W must be at least at the edge of the pool wall or in the water.

Referring to FIG. 2, an exemplary diagram and chart for recording the measurements, in conjunction with type I pool standards, and FIG. 3, an exemplary diagram and chart for recording the measurements in conjunction with type II pool standards, in use, the various values may be recorded on the chart to memorialize the measurements and confirmation of the compliance with the standards.

FIG. 4 illustrates an exemplary chart and placement diagram illustrating the dimensions of exemplary diving boards that would be acceptable under the standards, and positioning directions for placement of a board mounting jig for marking location of installation of the board support for a particular configuration of diving board, to ensure proper positioning and placement of the board to meet the standards. Each board model and type might have different values for the measurements and the table may be longer or shorter than illustrated, depending on individual diving board model details.

Accordingly, in the particular illustrated embodiment, the tool is suitably adapted for use with either type I or type II pool standards, by use of the different texture or color markers to meet the different envelope requirements under the 2 different standards.

The tool 10 is in a preferred embodiment constructed of nylon webbing. The centerline is 60 ft long and the 5 cross-sections are all 30 ft long (15 feet on each side of the centerline). The template has several markings on it showing the user where they need to take depth measurements. The marks match the minimum dimensions for a type I & II pool as described in the ANSI/NSPI-5 2003 American National standard for Residential Inground Swimming Pools. Once set-up, the installer can easily measure each data point to determine if the pool meets the minimum requirements for a type I or II pool. If the pool meets the requirements, a diving board can be installed. The tool may suitably be provided with step by step instructions on how to properly set-up and use it. It also includes data collection forms that are used to:

Record the measurements taken

Determine if the pool meets the minimum requirements

Determine diving board type

Determine diving board location

The system may suitably be provided as a set including the web members pre-assembled and configured with markers and cross web placement pre-attached, together with instructions and forms such as those in FIG. 2 and FIG. 3, for recording measurements at the noted measurement positions.

In a particular embodiment, the colors of the markers are chosen as follows:

black: markers 46, 48, 54, 56 red: markers 51, 53, 63, 65, 67, 69, blue: 50, 52, 62, 64, 67, 68 both red and blue: 44, 70, 72 green: 58, 60 purple: 26, 28, 30, 32, 34, 36, 38, 40, 42

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A method of determining swimming pool compliance with diving board safety standards, comprising:

providing an elongate measurement member for placing along a direction of the pool on a diving board centerline axis;

providing plural elongate cross members for placement in spaced positions along the pool in directions across the diving board centerline axis;

observing at least one parameter of the pool at positions along ones of said measurement or cross measurement members.

2. The method according to claim 1, wherein said cross members comprise markers thereon for indicating the positions at which to observe parameters of the pool.

3. The method according to claim 2, wherein said observed parameter comprise pool depth.

4. The method according to claim 2, wherein said observed parameter comprises existence of obstructions in the pool.

5. The method according to claim 4, wherein markers are provided at positions of said measurement or cross measurement members for indicating type of parameter to be observed and position at which parameter is to be observed.

6. The method according to claim 5, wherein ones of said markers are provided with color to indicate the type of parameter to be observed.

7. The method according to claim 5, wherein said parameter comprises pool depth measurement.

8. A method of determining swimming pool compliance with diving board safety standards, comprising:

providing an elongate measurement member for placing along a first direction of the pool;

providing plural elongate cross members for placement in spaced positions along the pool in directions across an axis of the diving board;

observing at least one parameter of the pool at positions along ones of said measurement or cross measurement members.

9. The method according to claim 8, wherein said cross members comprise markers thereon for indicating the positions at which to observe parameters of the pool.

10. The method according to claim 9, wherein said observed parameter comprise pool depth.

11. The method according to claim 9, wherein said observed parameter comprises existence of obstructions in the pool.

* * * * *